US008593265B1

(12) United States Patent
Dornfeld

(10) Patent No.: US 8,593,265 B1
(45) Date of Patent: Nov. 26, 2013

(54) MOTORIZED WHEEL SYSTEM WITH WIRELESS REMOTE CONTROL UNIT FOR LADDERS

(76) Inventor: Gary Richard Dornfeld, Wellington, FL (US)

( * ) Notice: Subject to any disclaimer, the term of this patent is extended or adjusted under 35 U.S.C. 154(b) by 250 days.

(21) Appl. No.: 13/162,066

(22) Filed: Jun. 16, 2011

(51) Int. Cl.
*G08C 17/02* (2006.01)

(52) U.S. Cl.
USPC ..... 340/12.5; 182/13; 182/16; 182/127; 182/212

(58) Field of Classification Search
USPC ..... 182/16, 127, 212, 13; 340/12.5
See application file for complete search history.

(56) References Cited

U.S. PATENT DOCUMENTS

| | | | | |
|---|---|---|---|---|
| 1,293,066 | A | 2/1919 | Faulkner | |
| 1,563,700 | A | 12/1925 | Frankenstein | |
| 2,503,626 | A | 4/1950 | Mayberry | |
| 3,213,963 | A | 10/1965 | Vogt | |
| 5,148,892 | A | 9/1992 | Lu | |
| 5,653,305 | A * | 8/1997 | Duke | 182/13 |
| 5,816,364 | A | 10/1998 | Christy et al. | |
| 5,853,065 | A | 12/1998 | Hutson et al. | |
| 6,431,314 | B1 * | 8/2002 | Boulanger et al. | 182/63.1 |
| 6,533,067 | B2 * | 3/2003 | Chick | 182/16 |
| 6,799,660 | B1 | 10/2004 | Crawford | |
| 7,546,876 | B2 * | 6/2009 | McAfee | 166/298 |
| 2004/0155532 | A1 * | 8/2004 | Brotto | 307/326 |
| 2009/0038864 | A1 * | 2/2009 | Yun | 180/19.1 |

FOREIGN PATENT DOCUMENTS

| | | |
|---|---|---|
| GB | 2.458.327 | 9/2009 |

* cited by examiner

*Primary Examiner* — Daniel Wu
*Assistant Examiner* — Benyam Haile
(74) *Attorney, Agent, or Firm* — Michael I. Kroll

(57) ABSTRACT

A motorized wheel system with wireless remote for portable support structure such as ladders and scaffolds to enable a user to relocate the ladder without dismounting by attaching wheels to the portable structure's legs wherein the wheels are remotely controllable. The motorized wheel system with a remote control mechanism comprises a remote motorized wheel device associated with each leg, each having a power supply for driving a motor and a receiver that is in radio communication with a transmitter on a remote control mechanism used to remotely engage the power supply and steer the wheels.

3 Claims, 14 Drawing Sheets

INTEGRAL UNIT

RETRO-FITTED
ATTACHMENT SET

MOTORIZED WHEEL SYSTEM WITH WIRELESS REMOTE CONTROL UNIT FOR LADDERS

BACKGROUND OF THE INVENTION

1. Field of the Invention

The present invention relates generally to ladders and, more specifically, to motorized ladder device providing means for moving a ladder without having to dismount the ladder. Further provided is a remote control mechanism, preferably having a joystick, that is selectively mountable to the ladder whereby the user controls the direction of the ladder movement without having to dismount.

2. Description of the Prior Art

There are other ladder devices designed for moving a ladder. While these devices may be suitable for the purposes for which they where designed, they would not be as suitable for the purposes of the present invention as heretofore described.

It is thus desirable to provide a remote controlled ladder mobility system integral with a ladder during manufacture that comprises wheels descending below the four feet of an A-frame ladder having a motor and wireless receiver that responds to commands from a control mechanism that enables a user to mount a ladder, such as when painting, and direct the movement of the ladder during the painting task without having to dismount the ladder.

It is further desirable to provide an after market ladder-mountable motorized system utilizing a plurality of brackets and braces for retrofitting the system to existing A-frame ladders.

SUMMARY OF THE PRESENT INVENTION

A primary object of the present invention is to apply a motorized wheel system with a remote control mechanism for A-frame ladder whereby a user positioned on said ladder can move said ladder to a desired location through provided control mechanism without the need of dismounting the ladder to reposition it to a desired location.

Another object of the present invention is to provide a motorized wheel system with a remote control mechanism for A-frame ladders with motorized wheel devices associated with each ladder leg, each wheel device comprising at least two wheels powered by a battery operated motor in accordance with the user's commands as delivered to a receiver via a signal sent by the transmitter of the wireless remote control mechanism disposed on the top flight of the ladder.

Still yet another object of the present invention is to provide a motorized wheel system with a remote control mechanism for A-frame ladders wherein said remote control mechanisms are fixedly attached to said ladder forming an integral part thereof during manufacture.

An additional object of the present invention is to provide an after market motorized wheel system with a remote control mechanism for A-frame ladders utilizing a plurality of brackets, plates and brace members to enable the system to be retrofitted to existing ladders.

A still yet further object of the present invention is to provide a motorized wheel system with a remote control mechanism for A-frame ladders wherein the remote control mechanism comprises a housing, a joystick and a safety switch which must be depressed to actuate the user commands via the joystick and when released locks the wheels to prevent the casual or accidental movement thereof.

Another object of the present invention is to provide a motorized wheel system with a remote control mechanism for A-frame ladders wherein a rechargeable power supply energizes said motor.

Yet another object of the present invention is to provide a motorized wheel system with a remote control mechanism for A-frame ladders wherein the housing of the remote control mechanism further incorporates an electronic circuit and microprocessor powered by said power source for remotely synchronousically actuating movement of said wheel devices by said motor.

Still yet another object of the present invention is to provide a motorized wheel system with a remote control mechanism that can be adapted for employment with a scaffold.

An additional object of the present invention is to provide motorized device wherein said remote control mechanism can be portable.

A still yet further object of the present invention is to provide motorized device wherein said remote control further incorporates 360 degree servo motors integral with the remote wheeled devices to enable the 360 degree rotation of the ladder.

Additional objects of the present invention will appear as the description proceeds.

The present invention overcomes the shortcomings of the prior art by providing controllable mobility for a portable structure, such as a ladder or scaffolding, by attaching wheels to the portable structure's legs wherein the wheels are remotely controllable. The motorized wheel system with a remote control mechanism comprises a remote motorized wheel device associated with each leg, each having a power supply for driving a motor and a receiver that is in radio communication with a transmitter on a remote control mechanism used to remotely engage the power supply and steer the wheels.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
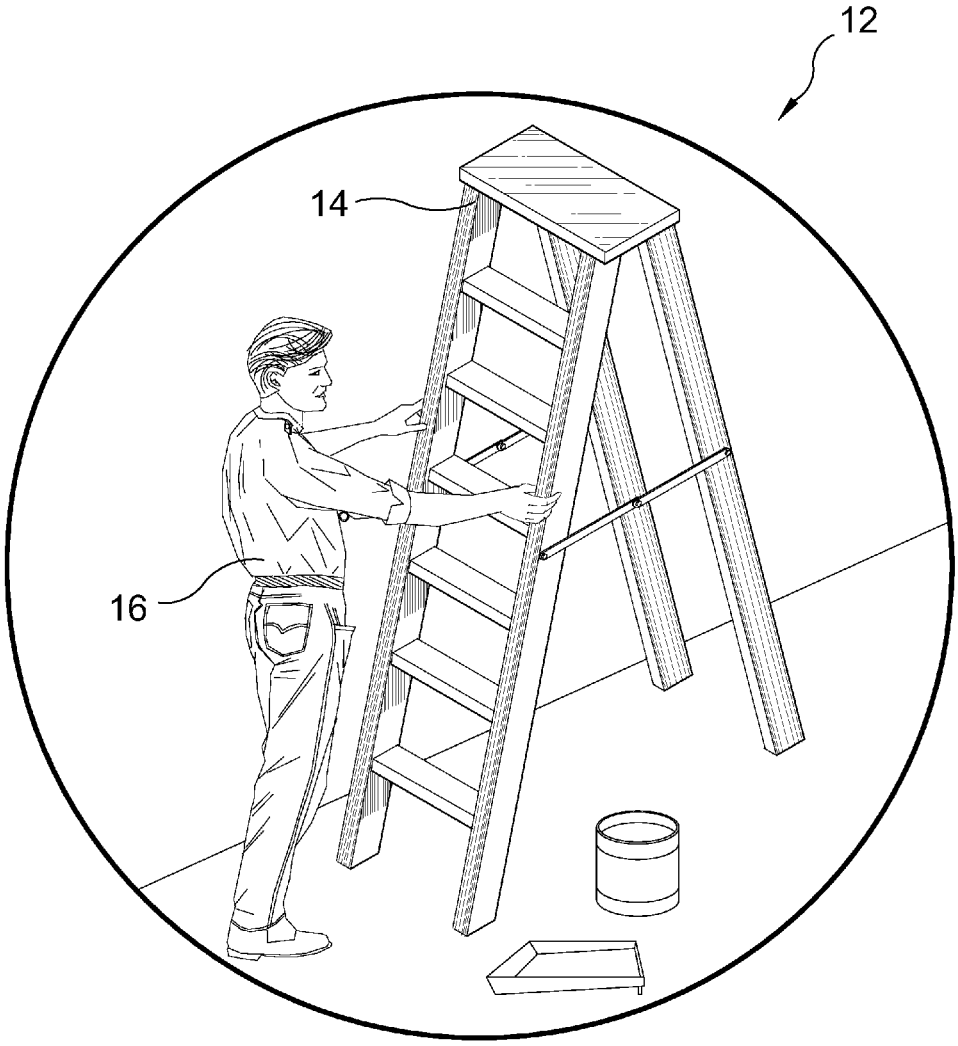
FIG. 1 is an illustrative view of prior art.

Turning now descriptively to the drawings, in which similar reference characters denote similar elements throughout the several views, the figures illustrate the Remote Mobility System for Portable Support Structures of the present invention. With regard to the reference numerals used, the following numbering is used throughout the various drawing figures.

10 Remote Mobility System for Portable Support Structures of the present invention
12 prior art
14 ladder
16 user
18 remote control mechanism
20 joystick
22 motorized wheel device
24 mounting assembly
26 top flight of 14
28 housing of 18
30 remote transmitter
32 wheel
34 rechargeable
36 drive motor
38 wireless receiver
40 360 degree servo motor
42 bearing
44 mounting plate
46 slide rail
48 slide plate
50 brace
52 flange
54 lower step of 14
56 ladder leg
58 dual wheel configuration of 22
60 center support body plate
62 support plate
64 step face return
66 set screw
68 microprocessor
70 safety button of 20
72 retrofit attachment set of 18
74 clamping element of 72
76 scaffold
78 scaffold boot
80 boot housing
82 receptacle of 82
84 boot insert
86 scaffold leg
88 drive shaft
90 signal
92 attachment means of 18
94 strap

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of prior art 12. When utilizing a conventional ladder 14, the user 16 must dismount the ladder 14 each time a work zone is complete and move it to the next zone thus interrupting progress and exerting physical energy. The present invention overcomes this problem by providing a battery operated mobile ladder that the user can control movement without dismounting said ladder.

Figure 2:
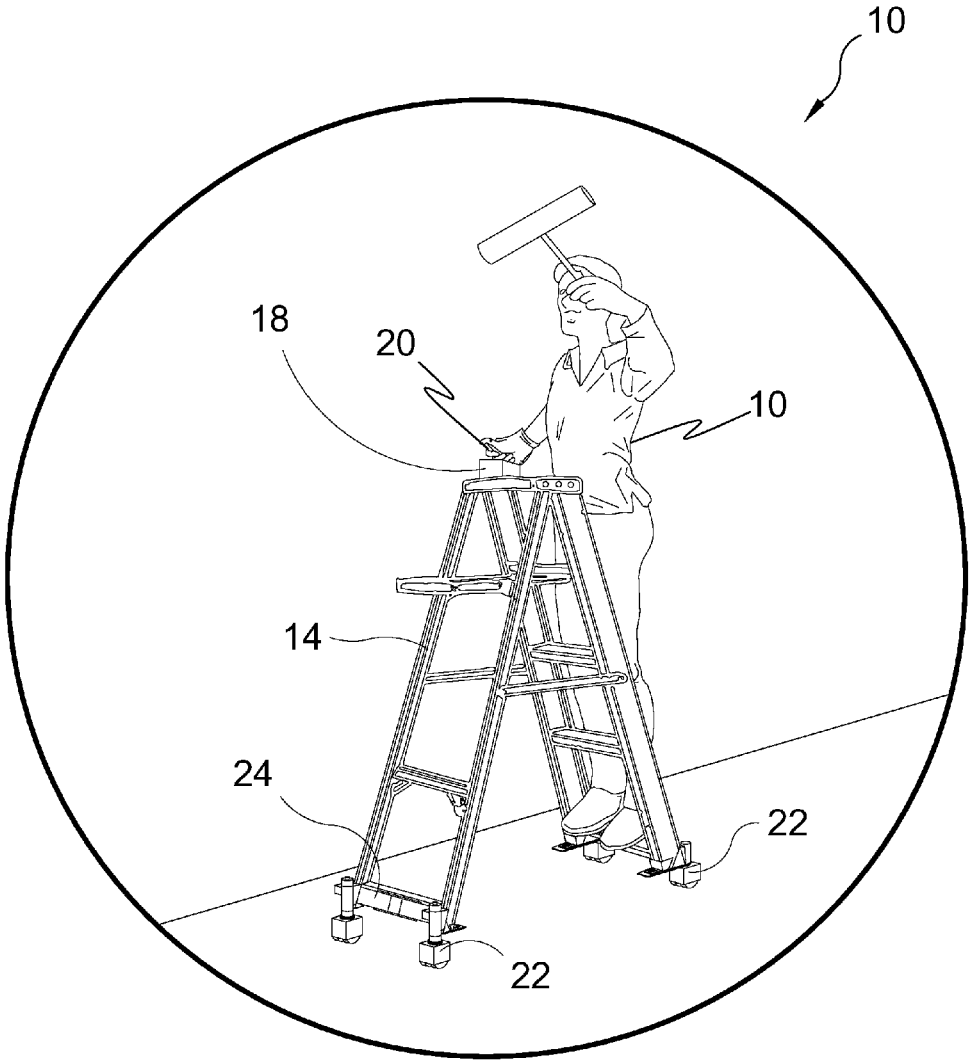
FIG. 2 is an illustrative view of the present invention in use.

FIG. 2 is an illustrative view of the present invention in use. Shown is the motorized wheel system with wireless remote 10 of the present invention having assemblies 24 adjustably fit and mounted to the legs of an existing A-frame ladder 14. A control mechanism 18 with a joystick 20 is either fixedly attached to the ladder 14 or selectively mountable to a desired location to provide for means of controlling the direction and speed of the ladder 14. The control mechanism 18 sends a signal to the motorized wheel device 22 to reposition the ladder 14 according to the user's 16

Figure 3:
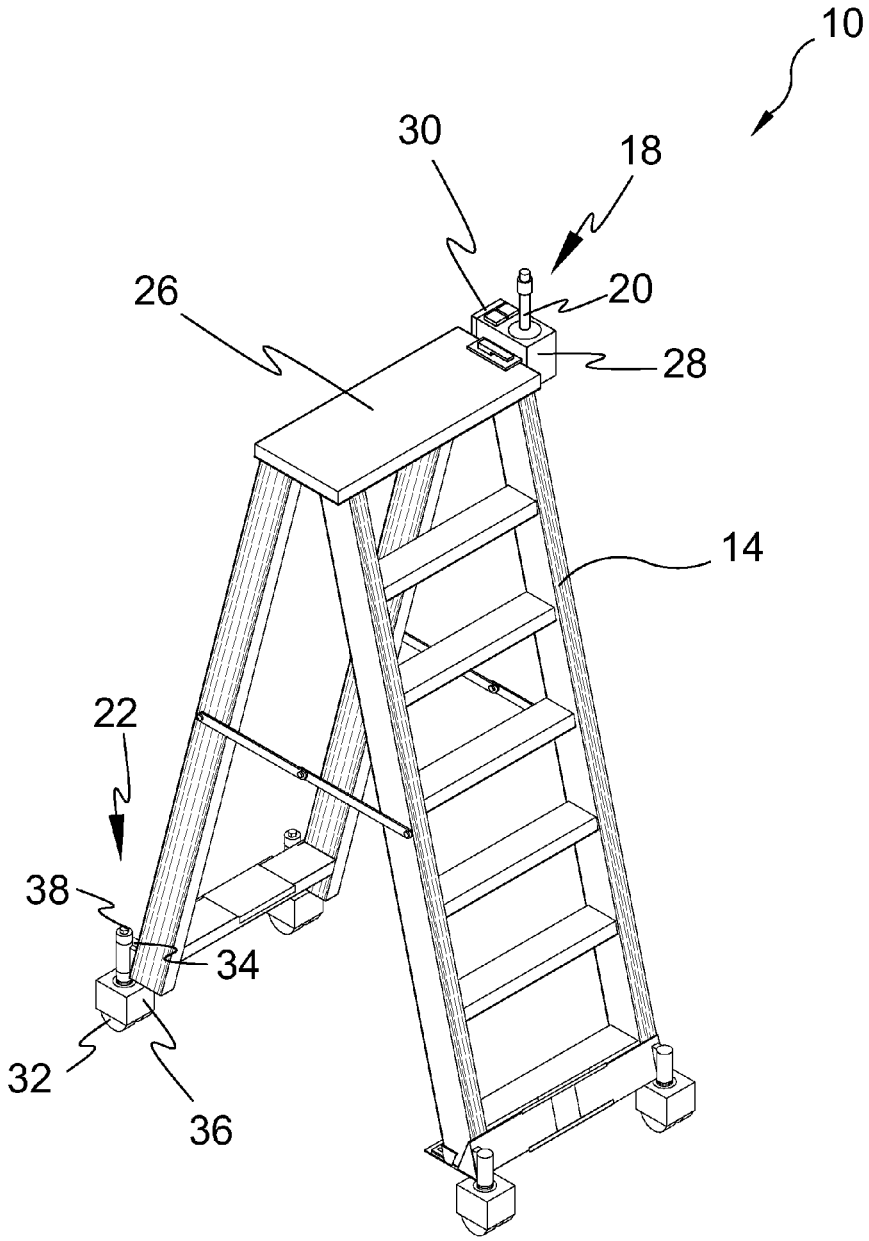
FIG. 3 is a perspective view of the present invention.

FIG. 3 is a perspective view of the present invention. Shown is the motorized wheel system with wireless remote 10 with the control mechanism 18 mounted to the top flight 26 of a ladder 14 having a housing 28, joystick 20 and remote transmitter 30. The remote wheel device 22 includes at least two wheels 32, a rechargeable battery 34, a motor 36 and a wireless receiver 38.

Figure 4:
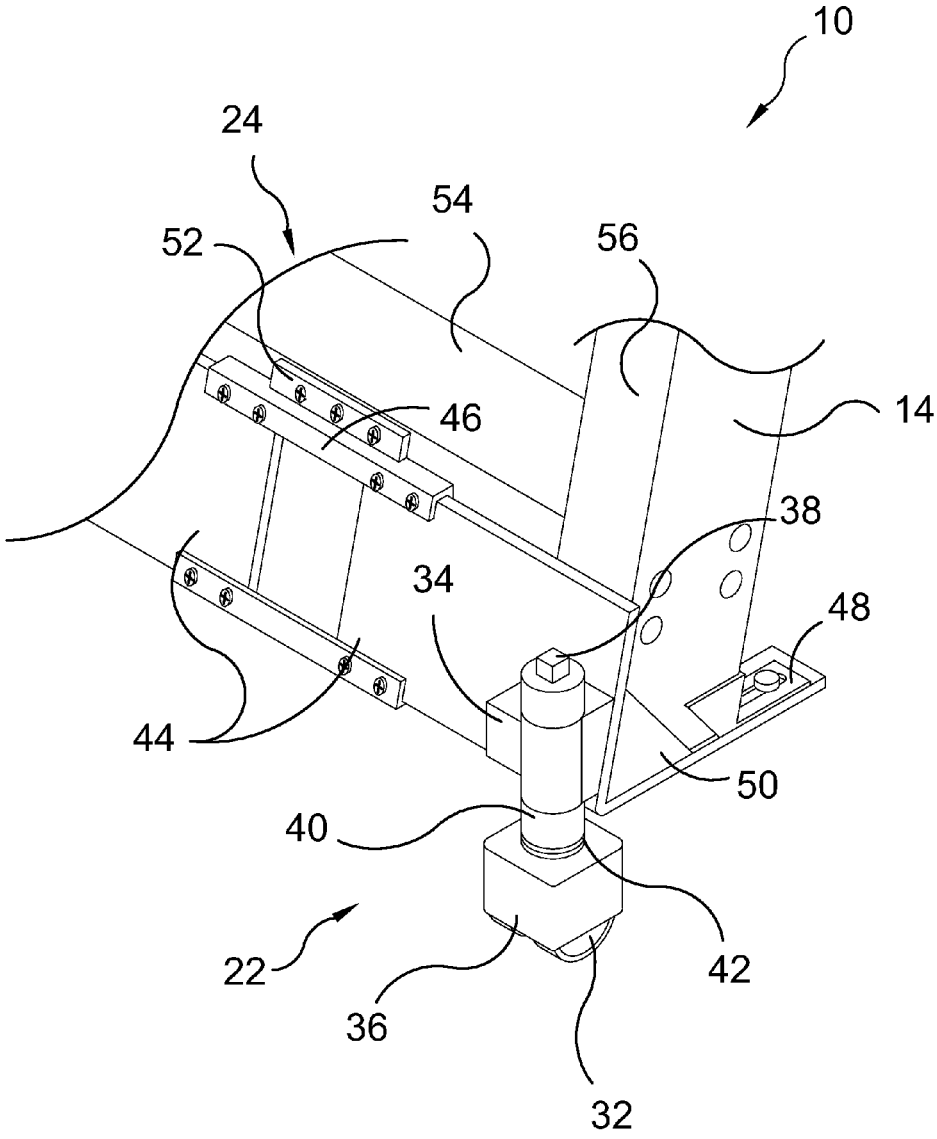
FIG. 4 is an illustrative view of the mounting assembly of the present invention.

FIG. 4 is an illustrative view of the mounting assembly 24 of the motorized wheel system with wireless remote 10. Shown is the mounting assembly 24 for mounting a plurality of motorized wheel devices 22 that are remotely controlled by a signal sent to the receiver 38. The wheels 32 are driven by a motor 36 and rotated by a 360 degree servo motor 40 to provide linear movement and directional rotation of the ladder. The motors are driven by a rechargeable battery 34 and include bearings 42. The mounting assembly 24 comprises mounting plates 44, slide rails 46, slide plates 48, braces 50 and flanges 52 for installation on the lower steps 54 and legs 56 of the ladder 14.

Figure 5:
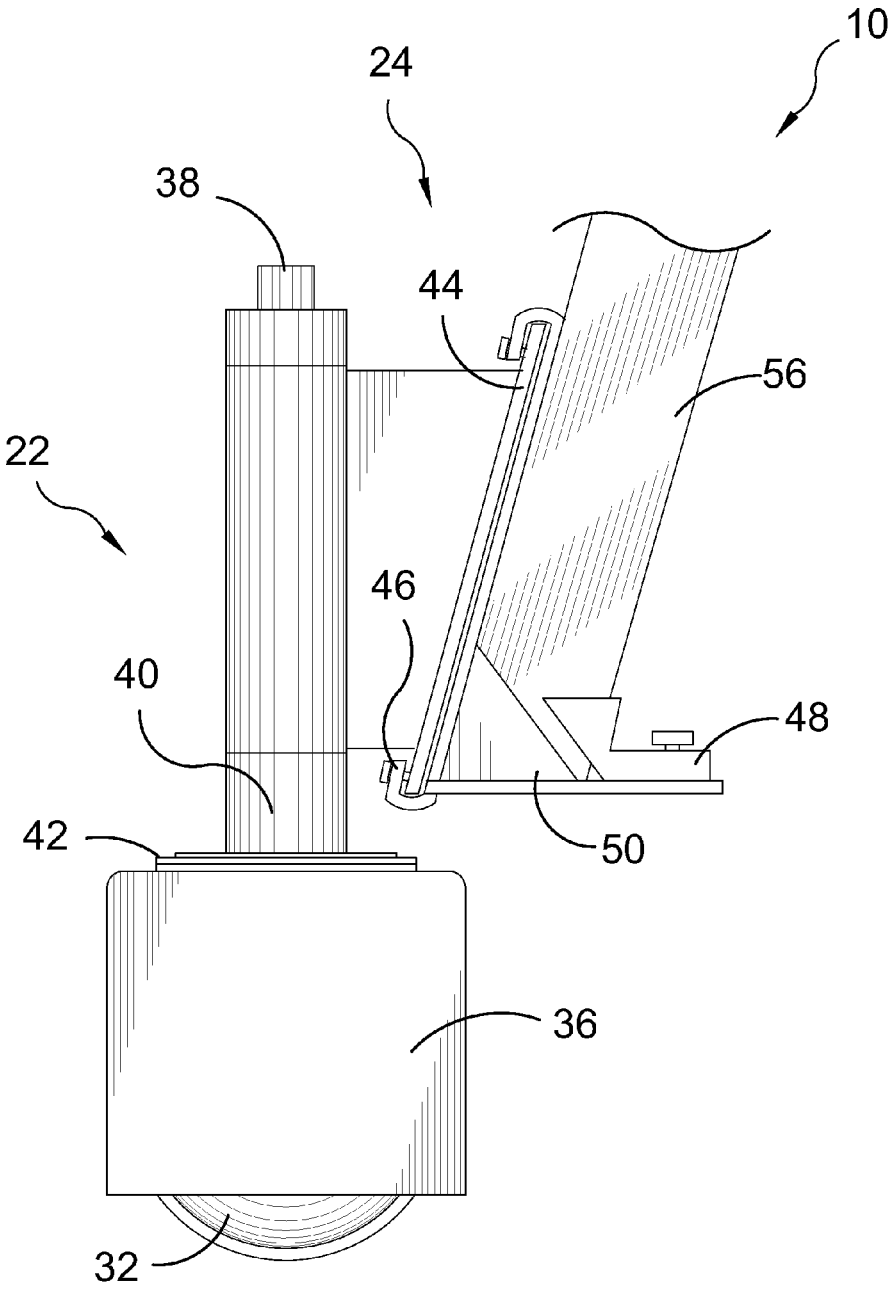
FIG. 5 is a side view of the remote wheel device and mounting assembly of the present invention.

FIG. 5 is a side view of the remote wheel device 22 and mounting assembly 24 of the present invention. Shown is the mounting assembly 24 for the motorized wheel device 22 fastened to the leg 56 of a ladder with a mounting plate 44, guide rail 46, brace 50 and slide plate 48. Also shown are the components of the motorized wheel device 22 comprising a wheel 32, drive motor 36, 360 degree rotational motor 40, bearing 42 and receiver 38.

Figure 6:
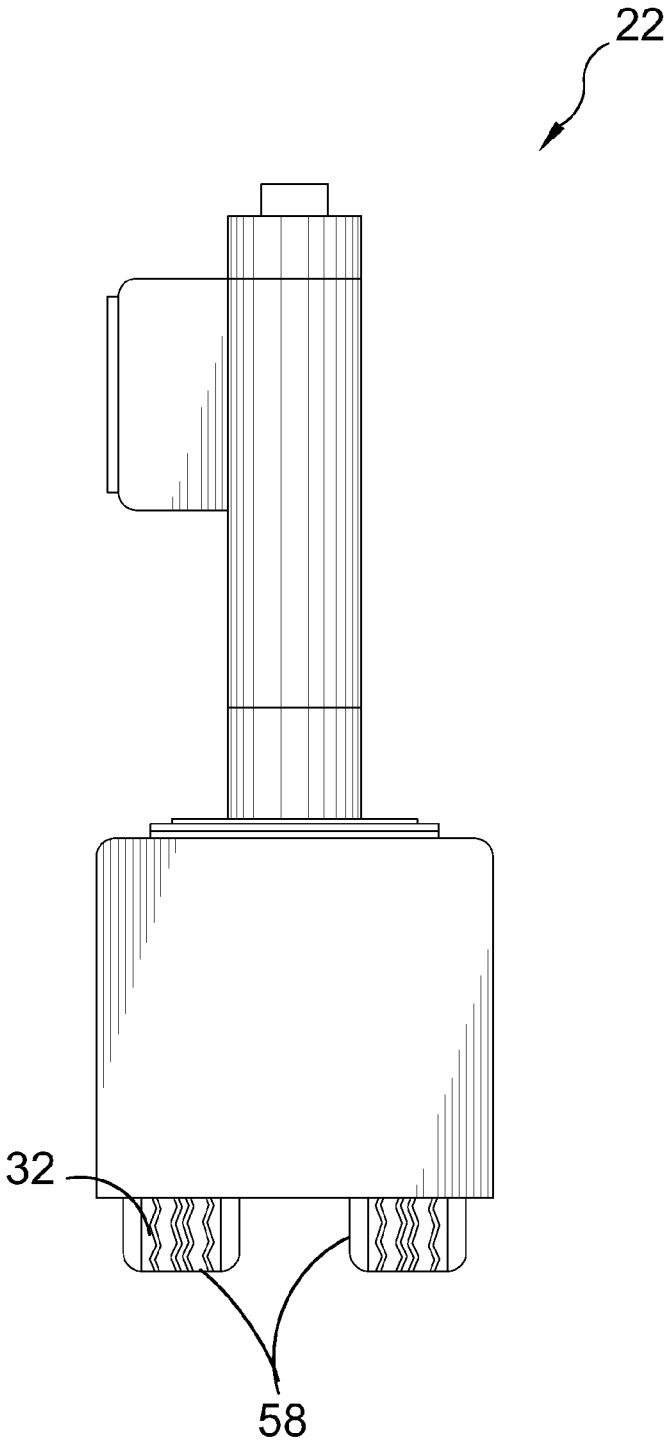
FIG. 6 is a front view of the remote wheel device employing two wheels.

FIG. 6 is a front view of the remote wheel device 22 employing two wheels 32. Illustrated on the remote motorized wheel device 22 is a dual wheeled configuration 58 is provided to facilitate the smooth and accurate rotation of all the wheel devices.

Figure 7:
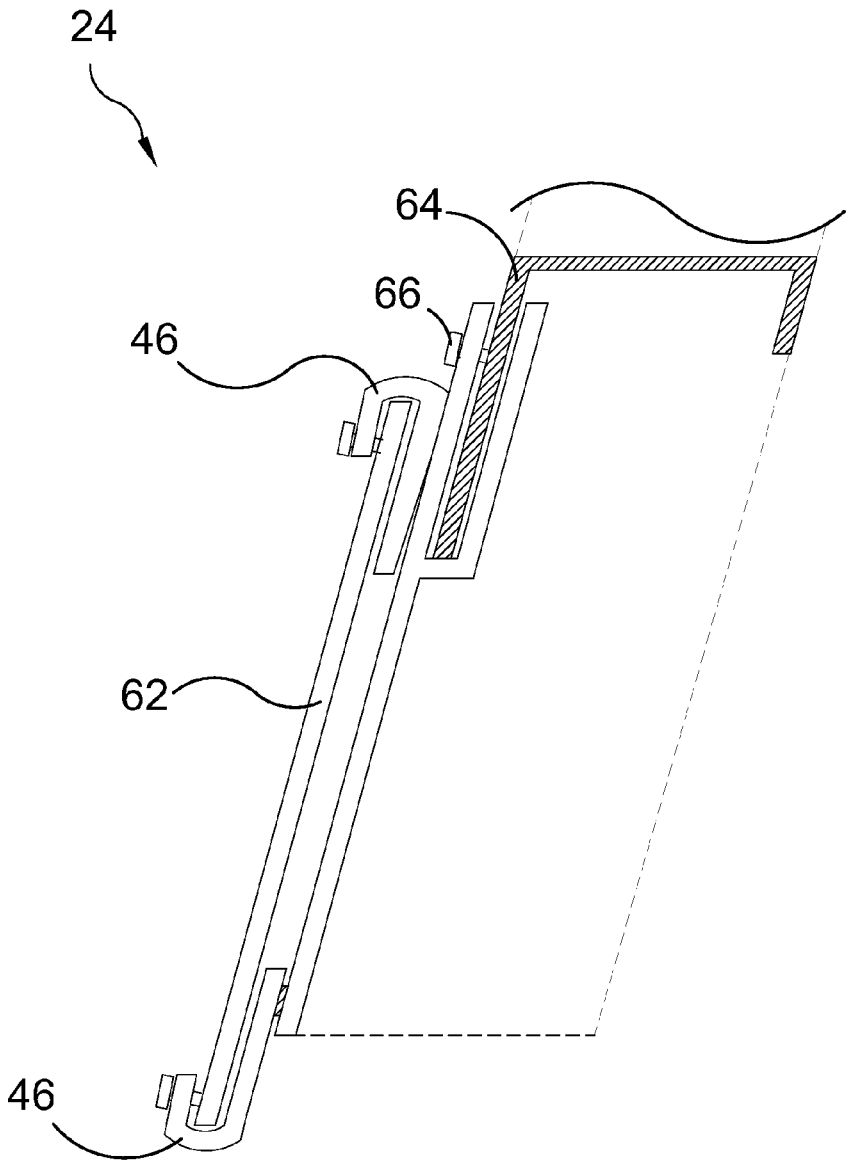
FIG. 7 is a side sectional view of the mounting assembly of the remote wheel device.

FIG. 7 is a side sectional view of the mounting assembly 24 of the remote wheel device. Depicted in FIG. 7 is the center support body plate 60, support plate 62, slide rails 46 of the mounting assembly secured to the step face return 64 with a plurality of set screws 66.

Figure 8:
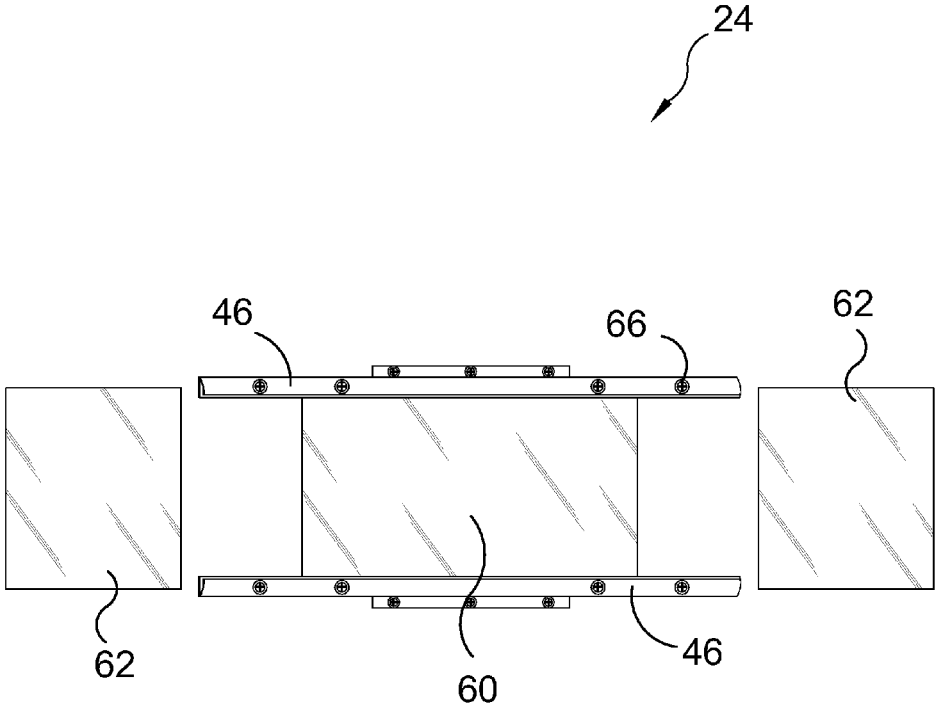
FIG. 8 is a front view of the mounting assembly of the present invention.

FIG. 8 is a front view of the mounting assembly 24 of the present invention. Demonstrated is the relationship of the slide rails 46, the center support plate 60, the support plates 62 and the plurality of set screws 66.

Figure 9:
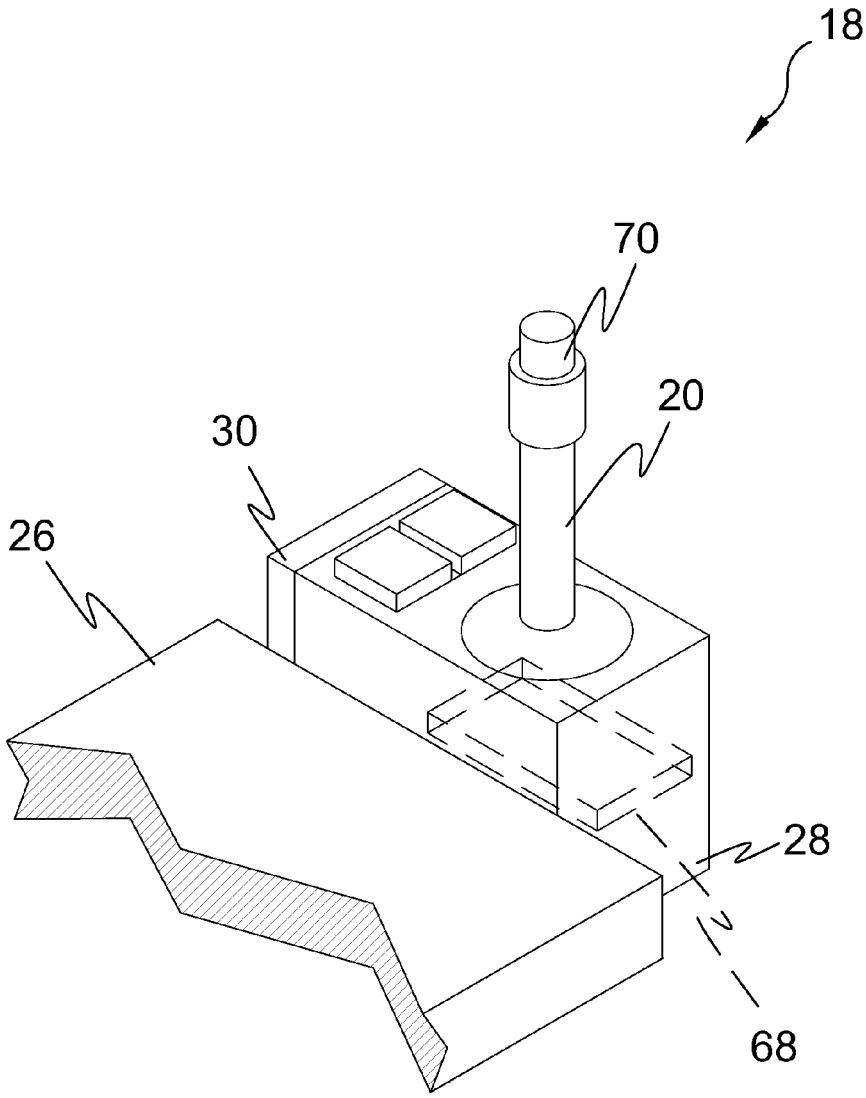
FIG. 9 is an illustrative view of integral control mechanism of the present invention.

FIG. 9 is an illustrative view of integral control mechanism 18 of the present invention. Shown is the control mechanism 18 integral with the top flight 26 of a ladder. The joystick 20 provides forward and reverse mode side to side toggle locked positions in communication with the transmitter 30. The housing 28 includes a microprocessor 68 to interpret the user commands as dictated by the movement of the joystick 20 and deliver the appropriate signal to each remote wheel device to coordinate the movement thereof. A safety button 70 is disposed on the top of the joystick 20 and must be depressed to actuate the wheels which otherwise remain in a locked position to prevent the inadvertent movement thereof.

Figure 10:
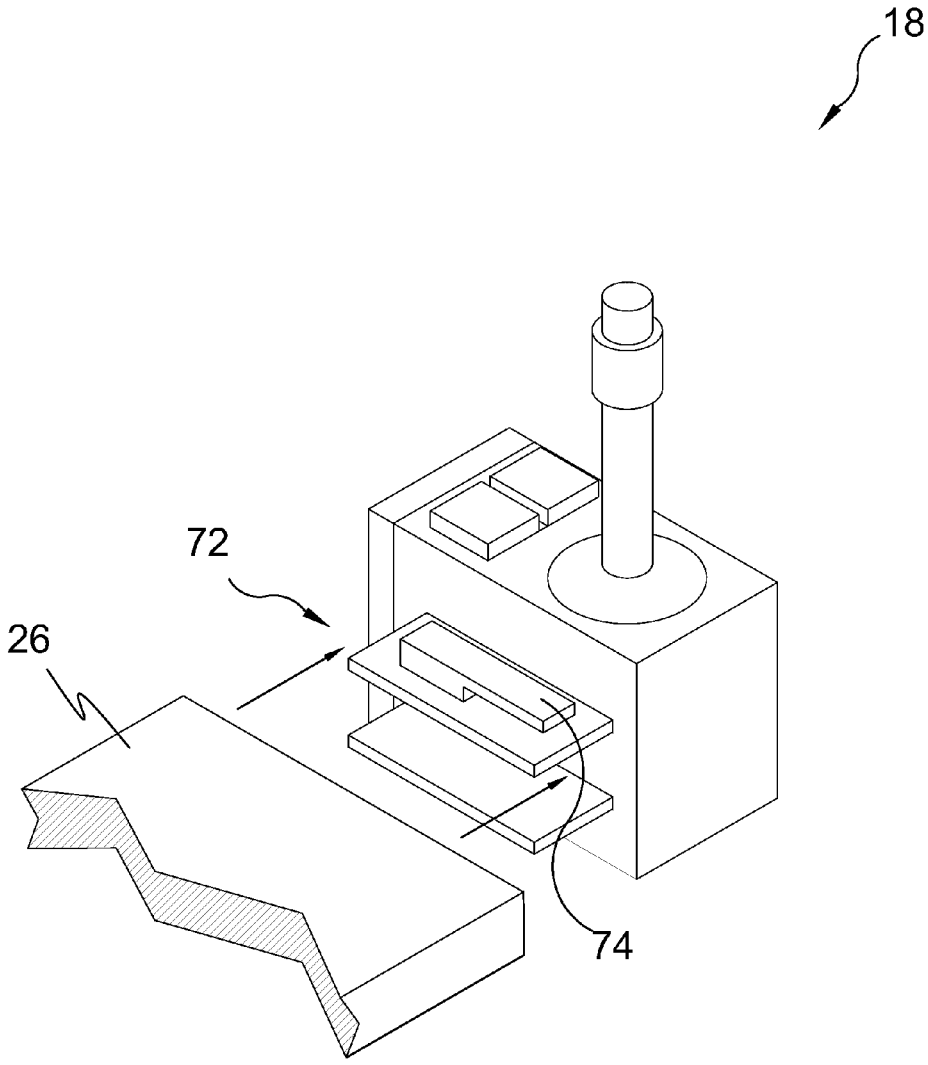
FIG. 10 is an illustrative view of a retro-fitted attachment set of the control mechanism.

FIG. 10 is an illustrative view of a retro-fit attachment set 72 of the control mechanism 18. The retro-fitted attachment set 72 of the control mechanism 18 provides a clamping element 74 for the attachment to the top flight of a ladder 26.

Figure 11:
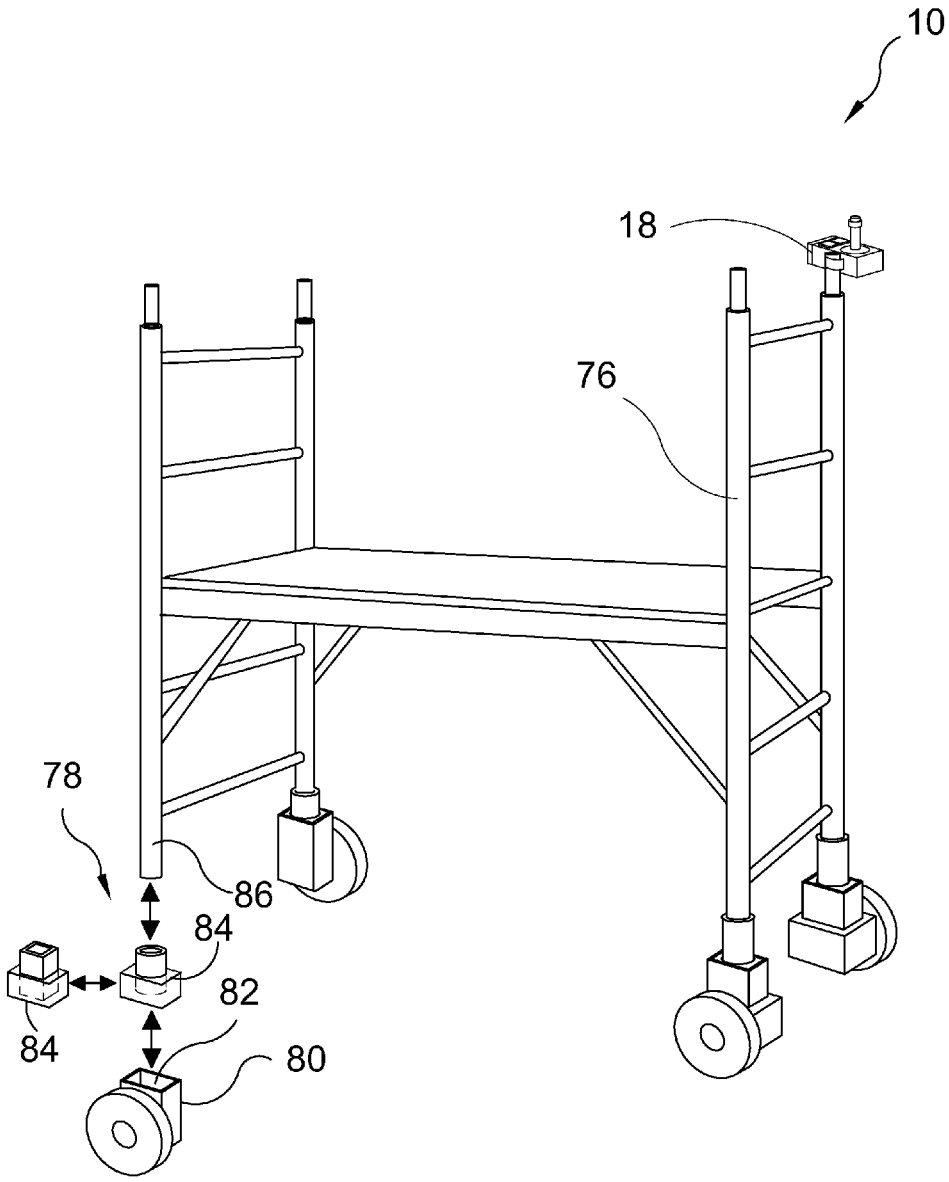
FIG. 11 is a perspective view of the present invention adapted for use with a scaffold.

FIG. 11 is a perspective view of the present invention adapted for use with a scaffold. The motorized wheel system with wireless remote 10 can be adapted for use with a scaffold 76, by attaching motorized wheel boots 78 that are motorized and remotely controllable to the legs. The motorized boot 78 of the present invention comprises a boot housing 80 having a receptacle 82 for receiving an insert 84 having a correspondingly shaped receptacle aperture into which the scaffold leg 86 is placed. The housing further incorporates a power supply for driving the servo motor and a receiver in radio communication with a remote controller having programmable logic controller 18 (plc) and transmitter circuit used to remotely engage the power supply and steer the wheel. Illustrated is a pair of scaffolding legs within freewheeling scaffolding receptacles having mobile footing providing mobility on one end of said scaffold. Motorized boots housing power supply, servo motor(s), mobile footing, receiver and circuit for actuating one or more servo motors to steer a mobile footing, whether wheel or track, in a desired vector with each boot acting independently providing omnidirectional scaffold movement controllable through (plc) chip and tactile directional and movement controls including safety switch that must be simultaneously engaged for movement control commands thereby preventing accidental scaffold movement through inadvertent tactile controller contact.

Figure 12:
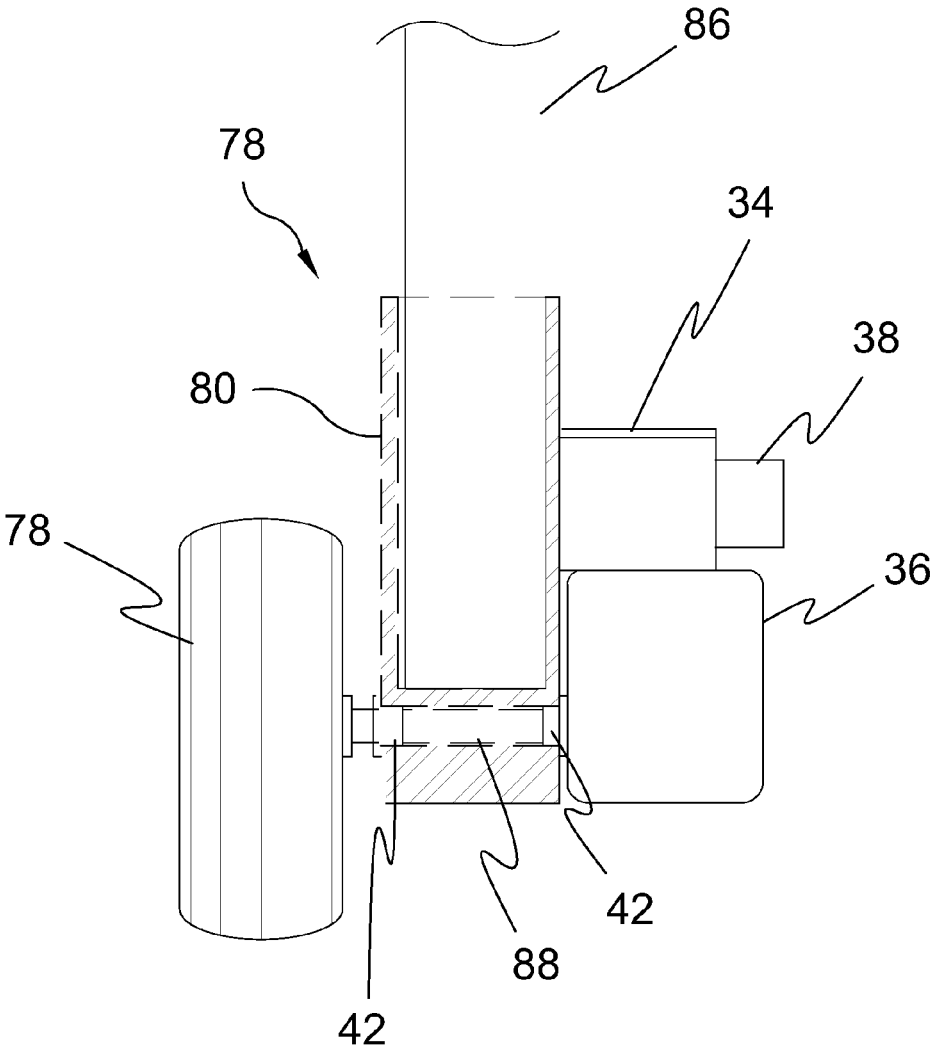
FIG. 12 is a sectional view of the mountable scaffold wheel.

FIG. 12 is a sectional view of the mountable scaffold drive boot 78. Shown is the drive boot 78 having a boot housing 80 to accept a scaffold leg 86, a wheel 32, drive shaft 88, bearings 42, motor 36, battery 34 and remote receiver 38 in communication with a joystick and remote transmitter device. Said joystick providing omnidirectional movement and neutral/wheel locked positions.

Figure 13:
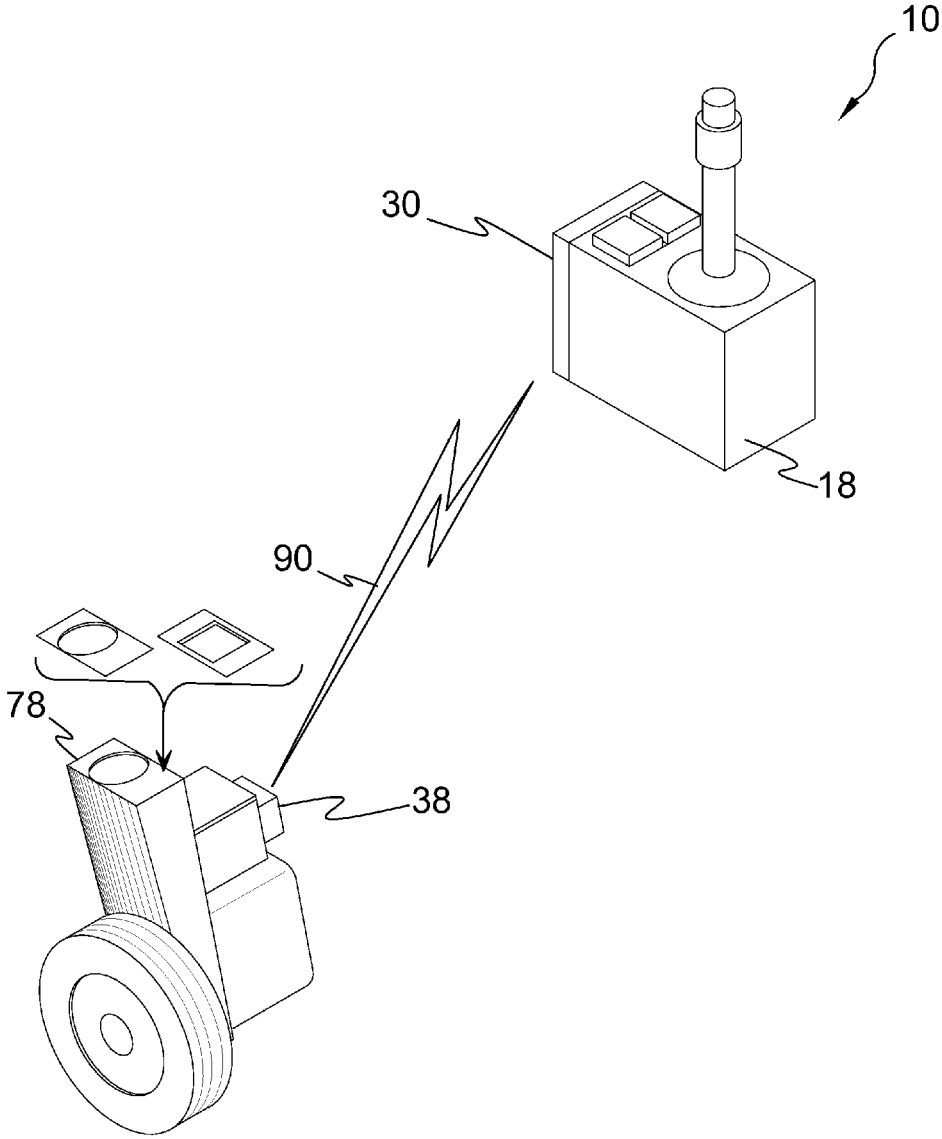
FIG. 13 is an illustrative view of the scaffold leg boot and control mechanism.

FIG. 13 is an illustrative view of the motorized wheel system with wireless remote 10 for use with scaffolding. Shown is the transmitter 30 of the control mechanism 18 delivering a signal 90 to the receiver 38 of the scaffold drive boot 78 having a receptacle aperture corresponding to the scaffold leg shape.

Figure 14:
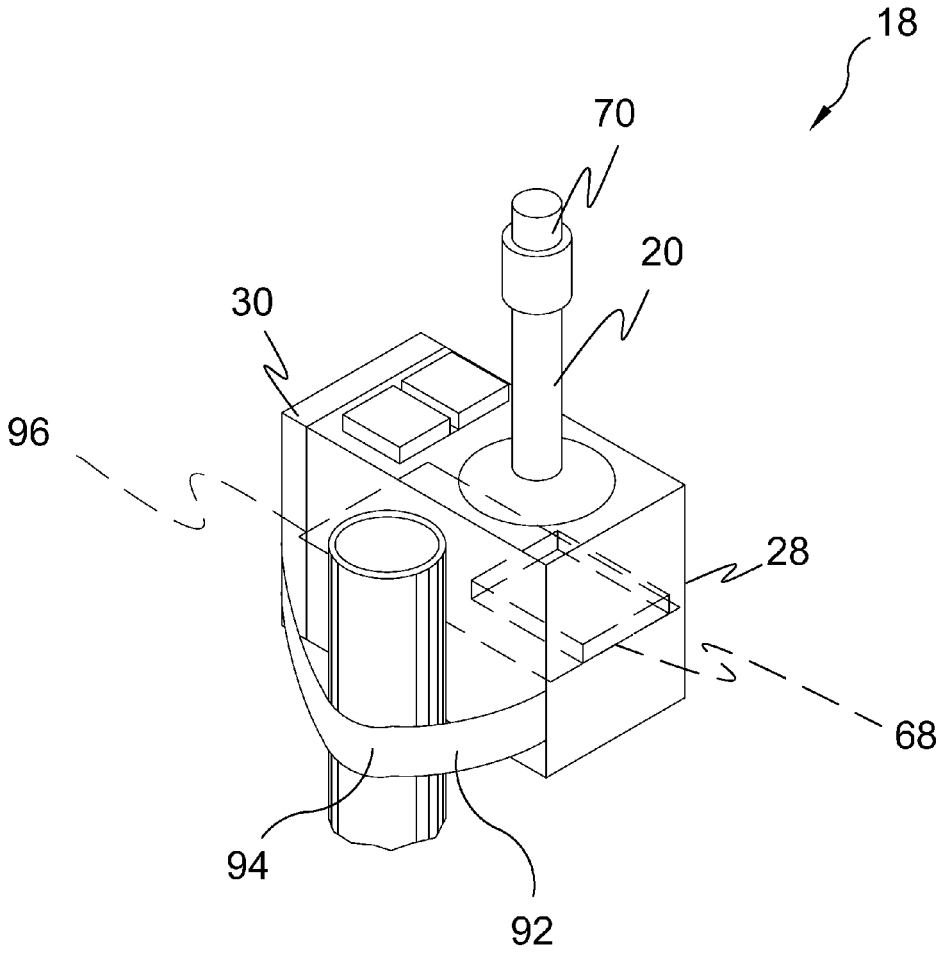
FIG. 14 is an illustrative view of the control mechanism mounted on a scaffold.

FIG. 14 is an illustrative view of the control mechanism 18 on the top portion of a scaffold 76. Shown is the control mechanism 18 secured to the top of a scaffold post 76 with an attachment means 92, depicted here as a strap 94. The joystick 20 provides forward and reverse mode side to side toggle locked positions in communication with the transmitter 30. The housing 28 includes a microprocessor 68 within the circuit 96 to interpret the user commands as dictated by the movement of the joystick 20 and deliver the appropriate signal to each remote wheel device to coordinate the movement thereof. A safety button 70 is disposed on the top of the joystick 20 and must be depressed to actuate the wheels which otherwise remain in a locked position to prevent the inadvertent movement thereof. It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

The invention claimed is:

1. A method of utilizing a motorized wheel system with wireless remote for A-frame ladders to enable a user to relocate the ladder without dismounting comprising the steps:

a) providing at least two motorized wheel devices for a pair of ladder legs each comprising at least one wheel; a motor and shaft in communication with said wheel for driving said wheel, a 360 degree servo motor for rotating said wheel device; a rechargeable battery for energizing said motors, a wireless receiver for receiving command signals from a remote transmitter;

b) providing a remote control mechanism comprising a housing; a joystick projecting from the top portion of said housing, a safety button disposed at the distal end of said joystick which disables system in the locked position when in the static state and actuates the system when depressed, a transmitter for delivering signals to said wireless receiver according to the user's movement of said joystick, a microprocessor for translating the movement of said joystick for delivering the appropriate signals to said wireless receivers of said motorized wheel devices;

c) depressing said safety button to actuate system and unlock wheels and keeping it depressed during operation;

d) moving said joystick to selectively reposition ladder;

e) microprocessor interpreting the movement said joystick to determine the action required of the two motors on each wheel device to perform the task and determining the appropriate signals to be sent thereto;

f) remote transmitter delivering said signals to said wireless receivers;

g) remote receivers receiving said signals;

h) actuating said motors to drive said wheels and said 360 degree servo motors if rotation is required;

i) continuing the process until the ladder is positioned in the desired location; and j) releasing the safety button to disable the system and lock said wheels in place.

2. The method of utilizing the motorized wheel system with wireless remote for A-frame ladders recited in claim 1, wherein the system is built integral with said ladder during manufacture.

3. The method of utilizing the motorized wheel system with wireless remote for A-frame ladders recited in claim 1, wherein the system is retrofit to an existing ladder with a mounting assembly.

* * * * *